US006502074B1

(12) United States Patent
Breen

(10) Patent No.: US 6,502,074 B1
(45) Date of Patent: Dec. 31, 2002

(54) SYNTHESISING SPEECH BY CONVERTING PHONEMES TO DIGITAL WAVEFORMS

(75) Inventor: Andrew Paul Breen, Suffolk (GB)

(73) Assignee: British Telecommunications public limited company, London (GB)

( * ) Notice: Subject to any disclaimer, the term of this patent is extended or adjusted under 35 U.S.C. 154(b) by 0 days.

(21) Appl. No.: 08/942,482

(22) Filed: Oct. 2, 1997

Related U.S. Application Data

(63) Continuation of application No. 08/166,998, filed on Oct. 23, 1995, now abandoned.

(30) Foreign Application Priority Data

Aug. 4, 1993 (EP) ..... 933062192

(51) Int. Cl.[7] ..... G10L 5/00
(52) U.S. Cl. ..... 704/260; 704/272
(58) Field of Search ..... 704/258, 260, 704/211, 243, 252

(56) References Cited

U.S. PATENT DOCUMENTS

| | | | | | |
|---|---|---|---|---|---|
| 4,692,941 | A | * | 9/1987 | Jacks et al. | 345/2.69 |
| 4,862,504 | A | * | 8/1989 | Nomura | 381/51 |
| 5,153,913 | A | * | 10/1992 | Kandefer et al. | 381/51 |
| 5,204,905 | A | * | 4/1993 | Mitome | 381/52 |
| 5,327,498 | A | * | 7/1994 | Hamon | 395/2.69 |
| 5,384,893 | A | * | 1/1995 | Hutchins | 395/2.76 |
| 5,490,234 | A | * | 2/1996 | Narayan | 395/2.69 |

OTHER PUBLICATIONS

Emerard et al., "Base de Donnees Prosodiques Pour la Synthese de la Parole", Journal Acoustique, vol. 1, No. 4, Dec. 1988, France, pp. 303–307.

Seung Kwon Ahn et al., "Formant Locus Overlapping Method to Enhance Naturalness of Synthetic Speech", Journal of the Korean Institute of Telematics and Electronics, vol. 28B, No. 10, Sep. 1991, Korea (see abstract).

Nakajima et al, "Automatic Generation of Synthesis Units Based on Context Oriented Clustering", International Conference on Acoustics, Speech and Signal Processing 88, vol. 1, Apr. 11, 1988, New York, pp. 659–662.

Chen, "Indentification and Contextual Factors Pronunciation Networks", International Conference on Acoustics, Speech and Signal Processing 90, vol. 2, Apr. 3, 1990, Albuquerque, NM, pp. 753–756.

Sagisaka, "Speech Synthesis by Rule Using an Optimal Selection of Non–uniform Synthesis Units", International Conference on Acoustics, Speech and Signal Processing 88, vol. 1, Apr. 11, 1988, New York, pp. 679–682.

* cited by examiner

*Primary Examiner*—David R. Hudspeth
*Assistant Examiner*—Michael N. Opsasnick
(74) *Attorney, Agent, or Firm*—Nixon & Vanderhye P.C.

(57) ABSTRACT

This invention relates to the generation of synthetic speech and specifically to the production of a digital waveform from a text in phonemes. The invention uses a linked database which comprises an extended text in phonemes and its equivalent in the form of a digital waveform. The two portions of the database are linked by a parameter which establishes equivalent points in both the phoneme text and the digital waveform. The input text (in phonemes) is analyzed to locate matching portion in the phoneme portion of the database. This matching utilises exact equivalence of phonemes where this is possible; otherwise relation between phonemes is utilised. The selection process identifies input phonemes in context whereby improved conversions are obtained. Having analyzed the input text into matching strings in the input form of the database beginning and ending parameters for the sections are established. The output text is produced by abutting sections of the digital waveform and defined by the beginning and ending parameters.

13 Claims, 1 Drawing Sheet

SYNTHESISING SPEECH BY CONVERTING PHONEMES TO DIGITAL WAVEFORMS

This is a file wrapper continuation of application Ser. No. 08/166,998, filed Oct. 23, 1995, now abandoned.

BACKGROUND

I. Field of the Invention

This invention relates to synthetic speech and more particularly to a method of synthesising a digital waveform from signals representing phonemes.

II. Related Art and Other Considerations

There are many circumstances, e.g. in telephone systems, where it is convenient to use synthesised speech. In some applications the starting point is an electronic representation of conventional typography, eg. a disk produced by a word processor. Many stages of processing are needed to produce synthesised speech from such a starting point but, as a preliminary part of the processing, it is usual to convert the conventional text into a phonetic text. In this specification the signals representing such a phonetic text will be called "phonemes". Thus this invention addresses the problem of converting the signals representing phonemes into a digital waveform. It will be appreciated that digital waveforms are common place in audio technology and digital-to-analogue converters and loud speakers are well known devices which enable digital waveforms to be converted into acoustic waveforms.

Many processes for converting phonemes into digital waveforms have been proposed and it is conventional to do this by means of a linked database comprising a large number of entries, each having an access portion defined in phonemes and an output portion containing the digital waveform corresponding to the access phonemes. Clearly all the phonemes should be represented in the access portions but it is also known to incorporate strings of phonemes in addition. However, existing systems only take into account the phoneme strings contained in the access portions and do not further take into account the context of the strings.

SUMMARY

This invention, which is defined in the claims, uses a linked database to convert strings of phonemes into digital waveform but it also takes into account the context of the selected phoneme strings. The invention also comprises a novel form of database which facilitates the taking into account of the context and the invention also includes the method whereby the preferred database strings are selected from alternatives stored therein.

DETAILED DESCRIPTION

Figure 1:
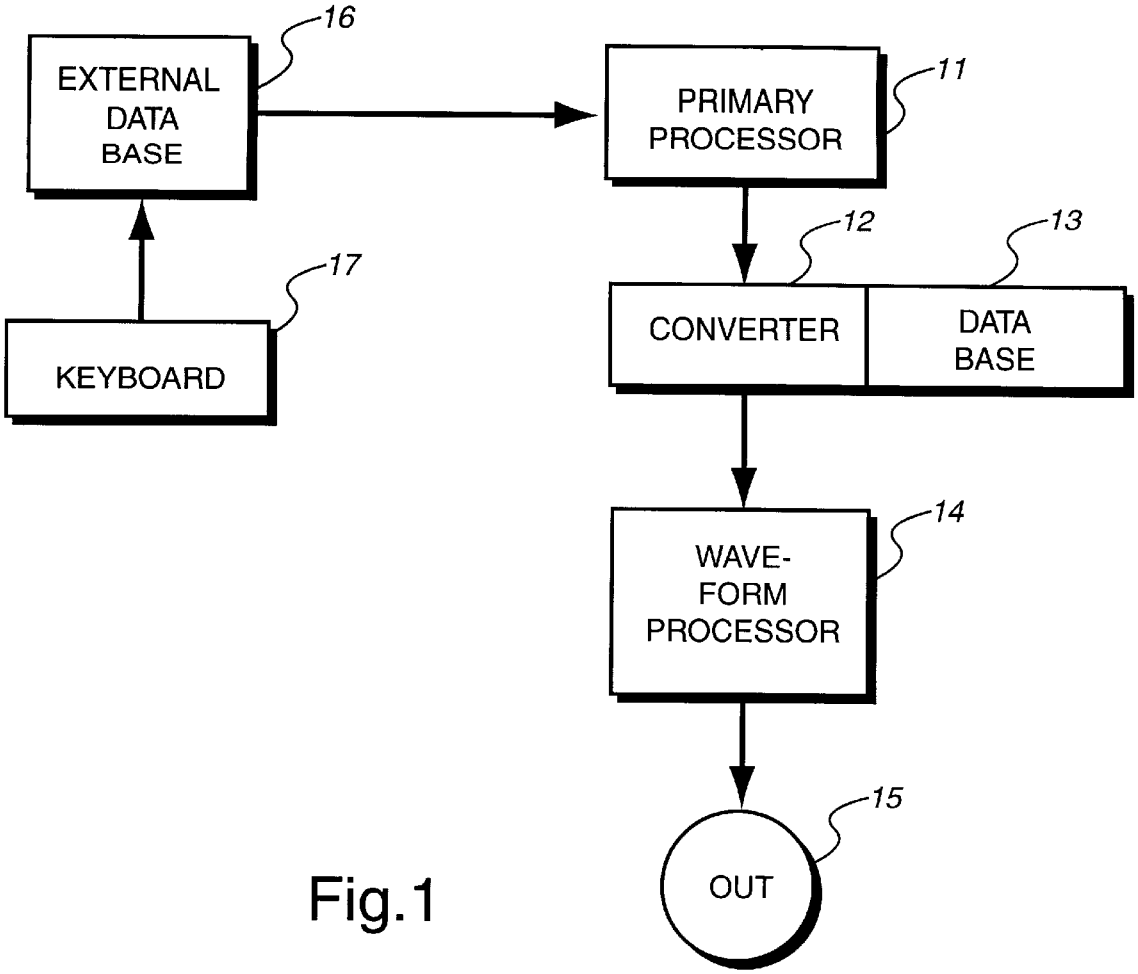
FIGS. 1 and 2 are schematic diagrams of a database in accordance with the invention
Figure 2:
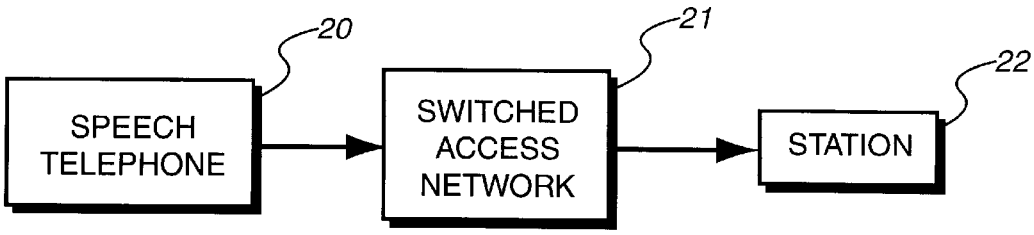

This general description is intended to identify some of the important integers of a preferred embodiment of the invention. Each of these integers will be described in greater detail after this general description.

The method of the invention converts input signals representing a text expressed in phonemes into a digital waveform which is ultimately converted into an acoustic wave. Before its conversion, the initial digital waveform may be further processed in accordance with methods which will be familiar to persons skilled in the art.

The phoneme set used in the preferred embodiment conform to the SAMP-PA (Speech Assessment Methologies—Phonetic Alphabet) simple set number 6. It is to be understood that the method of the invention is carried out in electronic equipment and the phonemes are provided in the form of signals so that the method corresponds to the converting of an input waveform into an output waveform.

The preferred embodiment of the invention converts waveform representing strings of one, two or three phonemes into digital waveform but it always operates on strings of five phonemes so that at least one preceding and at least one following phoneme is taken into account. This has the effect that, when alternative strings of five phonemes are available, the "best" context is selected.

It has just been explained that this invention makes particular use of a string of five phonemes and this string will hereinafter be called a "context window" and the five phonemes which constitute the "context window" will be identified as P1, P2, P3, P4 and P5 in sequence. It is a key feature of this invention that a "data context window" being five consecutive phonemes from the input signal is matched with an "access context window" being a sequence of five consecutive phonemes contained in the database.

The prior art includes techniques in which variable length strings are converted into digital waveform. However, the context of the selected strings is not taken into account. Each phoneme comprised in a selected string is, of course, in context with all the other phonemes of the string but the context of the string as a whole is not taken into account. This invention not only takes into account the contexts within the selected string but it also selects a best matching string from the strings available in the database. This specification will now describe important integers of preferred embodiment namely:

(i) the definition of "best" as used in the selections;

(ii) the configuration of the database which stores the signal representations of the data context windows together with their corresponding digital wave forms;

(iii) the method of selection for (ii) using (i); and (iv) picking one of the various alternatives provided by (iii).

Definition of "Best"

This invention selects from alternative context windows on the basis of a "best" match between the input context window and the various stored context windows. Since there are many, e.g. $10^8$ or $10^{10}$ possible contexts windows (of 5 phonemes each) it is not possible to store all of them, i.e. the database will lack some of the possible context windows. If all possible context windows were stored it would not be necessary to define a "best" match since an exact correspondence would always be available. However, each individual phoneme should be included in the database and it is always possible to achieve an exact match for at least one phoneme, in the preferred embodiment it is always possible to match exactly P3 of the data context window with P3 of the stored context window but, in general, further exact matches may not be possible.

This invention defines a correlation parameter between two phonemes as follows. Corresponding to each phoneme there is a type-vector which consists of an ordered list of co-efficients. Each of these co-efficients represents a feature of its phoneme, e.g. whether its phoneme is voiced or unvoiced or whether or not its phoneme is a silibant, a plosive or a labil. It is also desirable to include locational features, eg whether or not the phoneme is in a stressed or unstressed syllable. Thus the type vector uniquely characterises its phoneme and two phonemes can be compared by comparing their type-vectors co-efficient by co-efficient; e.g. by using an exclusive-or gate (which is sometimes called an equivalence gate). The number of matchings is one way of defining the correlation parameter. If desired this can be converted to a percentage by dividing by the maximum possible value of the parameter and multiplying by 100.

(As an alternative, a mis-match parameter can be defined e.g. by counting the number of discrepancies in the two type vectors. It will be appreciated that selecting an "best" match is equivalent to selecting a lowest mis-match.)

The primary definition relates to the correlation parameter of a pair of phonemes. The correlation parameter of a string is obtained by summing or averaging the parameters of the corresponding in pairs in the two strings. Weighted averages can be utilized where appropriate.

Database

In the preferred embodiment, the database is based on an extended passage of the selected language, e.g. English (although the information content of the passage is not important). A suitable passage lasts about two or three minutes and it contains about 1000–1500 phonemes. The precise nature of the extended passage is not particularly important although it must contain every phoneme and it should contain every phoneme in a variety of contexts.

The extended passage can be stored in two different formats. First the extended passage can be expressed in phonemes to provide the access section of a linked database. More specifically, the phonemes representing the extended passage are divided into context windows each of which contains 5 phonemes. The method of the invention comprises obtaining best matches for the data context windows with the stored context windows just identified.

The extended passage can also be provided in the form of a digitised wave form. As would be expected, this is achieved by having a reader or reciter speak the extended passage into a microphone so as to make a digital recording using well established technology. Any point in the digital recording can be defined by a parameter, e.g. by the time from the start. Analyzing the recording establishes values for the time-parameter corresponding to the break between each pair of phonemes in the equivalent text. This arrangement permits phoneme-to-waveform conversion for any included string by establishing the starting value of the time-parameter corresponding to the first phoneme of the string and the finishing value for the time-parameter corresponding to the last phoneme of the string and retrieving the equivalent portion of database, i.e. the specified digital waveform. Specifically a conversion for any string of one, two or three phonemes can be achieved.

The important requirement is to select the best portion of the extended text for the conversion.

It has already been mentioned that the phoneme version of the extended text is stored in the form of context windows each of five phonemes. This is most suitably achieved by storing the phonemes in a tree which has three hierarchical levels.

As shown in FIG. 1, database 10 has an input or access section 12 and an output section 14. As mentioned above, input section 12 includes the extended passage or extended text which is stored in three hierarchical levels 21, 22, and 23.

The first level of the hierarchy is defined by phoneme P3 of each window. The effect is that every phoneme gives direct access to a subset of the context windows i.e. the totality of context windows is divided into subsets and each subset has the same value of P3.

The next level of the tree is defined by phonemes P2 and P4 and, since this selection is made from the subsets defined above, the effect is that the totality of context windows is further divided into smaller subsets each of which is defined by having phonemes P2, P3 and P4 in common. (There are approximately half a million subsets but most of them will be empty because the relevant sequence P2, P3, P4 does not occur in the extended text). Empty subsets are not recorded at all so that the database remains of manageable size. Nevertheless it is true that for each triple sequence P2, P3, P4 which occurs in the extended text there will be a subset recorded in the second level of the database under P2, P4 which level will also have been indexed at the first level under P3.

Finally the second level gives access to a third level which contains subsets having P2, P3 and P4 as exact matches and it contains all the values of P1 and P5 corresponding to these triples. Best matches for data P1 and P5 are selected. This selection completely identifies one of the context windows contained in the extended text and it provides access to time-parameters of said window. Specifically it provides start and finish time-parameters for up to four different strings as follows:

(a) P3 by itself;

(b) the pair of phonemes P2+P3;

(c) the pair of phonemes P3+P4; and (d) the triple consisting of the phonemes P2+P3+P4.

In the first instance, the database provides beginning and ending values of the time-parameter corresponding to each one of the selected strings (a)–(d). As explained above, the time-parameter defines the relevant portion of a digital wave form so that the equivalent wave form is selected.

It should be noted that item (d) will be offered if it is contained in the database; in this case items (a), (b), and (c) are all embedded in the selected (d) and they are, therefore, available as alternatives. If item (d) is not contained in the database then, clearly, this option cannot be offered.

Even if item (d) is missing from the database, then items (b) and/or (c) may still be present in the database. When both of these options are offered they will usually arise from different parts of the database because item (d) is missing. Therefore, depending on the content of the database, the selection will offer (b) alone, or (c) alone, or both (b) and (c). Thus the selection may provide a choice and in any case item (a) is available because it is embedded in the pair.

Finally, even if (b), (c) and (d) are all absent from the database, item (a) will always be present and thus "best match" will be offered for the single phoneme and this will be the only possibility which is offered.

It will be apparent that items (b), (c) and (d) imply that strings will overlap. Thus whenever item (c) is selected for any phoneme then item (b) must be available for the next phoneme. If nothing better is offered, then the same part of the database will meet the requirements of (c) for the earlier phoneme and (b) for the later but because different correlations are involved better choices may be selected. It will also be apparent that whenever item (d) is available item (c) will be available for the previous phoneme and, in addition, item (b) will be available for the following phoneme. In other words, some of the strings will overlap, ie there will be alternatives for some phonemes such that the same phoneme occurs in different places in different strings. This aspect of the invention is described in greater detail below.

It has been emphasised that the preferred embodiment is based on a context window which is five phonemes long. However the full string of five phonemes is never selected. Even if, fortuitously, the input text contains a string of five found in the database only the triple string P2, P3, P4 will be used. This imphasizes that the important feature of the invention is the selection of a string from a context and, therefore, the invention selects the "best" context window of five phonemes and only uses a portion thereof in order to ensure that all selected strings are based upon a context.

Selection of "Best" Window

The analysis of the text into phonemes contained in the database is carried out phoneme by phoneme, but each phoneme is utilized in its context window. The next part of the description will be based upon the selection procedure for one of the data phonemes it being understood that the same procedure is used for each of the data phonemes.

The selected data phoneme is not utilized in isolation but as part of its context window. More precisely the selected data phoneme becomes phoneme P3 of a data window with its two predecessors and two successors being selected to provide the five phonemes of the relevant context window. The database described above is searched for this context window; since it is unlikely that the exact window will be located, the search is for the best fitting of the stored context windows.

The first step of the search involves accessing the tree described above using phoneme P3 as the indexing element. As explained above this gives immediate access to a subset of the stored context windows. More specifically, accessing level one by phoneme P3 gives access to a list of phoneme pairs which correspond to possible values of P2 and P4 of the data context-window. The best pair is selected according to the following four criteria.

First criterion Fortuitously, it may happen that one pair in the sub-set gives an exact match for data P2 and P4. When this happens that pair is selected and the search immediately proceeds to level 3. This outcome is unlikely because, as explained in greater detail above, the string P2, P3, P4 may not be contained in the extended passage.

Second criterion. In the absence of a triple match a left pair will be selected if it occurs. The left-hand match is selected when an exact match for P2 is found and, if alternatives offer, the P4 which has the highest correlation parameter will be selected to give access to level 3 of the tree.

The third criterion is similar to the second except that it is a right-hand pair depending upon an exact match being discovered for P4. In this case access to level 3 is given by the P2 value which provides the highest correlation parameter.

Criterion four occurs when there is no match for either P2 or P3 in which the case the pair P2, P4 with the highest average correlation parameter is selected as the basis of access to level 3.

It will be noted that if criterion 1 succeeds, then it will be possible to take as alternatives a left-hand pair, a right-hand pair and a single value in accordance with criterion 2, 3 and 4.

Even if criterion 1 fails, it is still possible that a left-hand pair will be found by criterion 2 and it is even possible that, simultaneously, a right-hand pair will be found by criterion 3. However because criterion 1 has failed they will be selected from different parts of the database and they will give access to different parts of the tree at level 3.

Finally criterion 4 will only be accepted when criterion 1, 2 and 3 have all failed and it follows that the phoneme P3 cannot be found in triples or pairings when used in other context windows.

Thus, when criterion 1 or 4 are utilized there will only be access to one portion of the tree at the third level but it is possible, when criterion 2 and 3 are used that there will be access to two different parts of the third level.

We have now described how the selection of a context window gives rise to either one or two areas of the third level of the tree. In each case the third level may contain several pairings for phonemes 1 and 5 of the data context window. The pair with the best average correlation parameter is selected as the context window in the access portion of the database. As explained above this context window is converted to digital wave form using the time-parameter.

To re-emphasise; where criterion 1 is used only one context window is selected but is gives (a) rise to four possibilities namely time-parameter ranges for the triple P2+P3+P4; (b) for the left-hand pair P2+P3; for the right-hand pair P3+P4 and, (c) for the single P3 by itself.

When criterion 2 operates, this provides time-parameter ranges only for the left-hand pair P2+P3 and for a single P3 by itself. When criterion 3 operates similar considerations apply but the parameter ranges are for the right-hand pair P2+P3 and for the single P4. If both criterion operate this offers two choices for the single P3 and only the one with the higher correlation parameter for P1+P5 is selected.

Finally when criterion 4 operates there only one possibility namely the phoneme P3 by itself.

The description given above explains how conversions are provided for each phoneme of an input text. Sometimes the method provides a conversion for only a single phoneme and, in this case, no alternatives are offered. In some cases the method provides conversion for strings of two or three adjacent phonemes and, in these circumstances, the conversion provides alternatives for at least one phoneme. In order to complete the selection, it is necessary to reduce the number of alternatives to one. The preferred method of achieving this reduction will now be explained.

The preferred method of making the reduction is carried out by processing a short segment of input text, e.g. a segment which begins and ends with a silence. Provided it is not too long a sentence constitutes a suitable segment. If a sentence is very long, e.g. more than thirty words, it usually contains one or more embedded silences, e.g. between clauses or other sub-units. In the case of long sentences such sub-units are suitable for use as the segments.

The processing of a segment to reduce each set of alternatives to one will now be described. As mentioned, no alternative will be offered for some of the phonemes and, therefore, no selection is required for these phonemes. Alternatives will be available for the other phonemes and the selection is made so as to produce a "best" result for the segment as a whole. This may involve making a locally "less good" selection at one point in the segment in order to obtain "better" selection elsewhere in the segment. The criteria of "better" include:

(i) taking longer strings rather than shorter strings, and (ii) selecting from strings which overlap rather than from strings which merely abut.

An "overlap" means that the last phoneme of an earlier string is the same as the first phoneme of the next following string. (It is to be understood that the length of the overlap is one phoneme). Overlaps are desirable and their use will be described further below. An "abutment" means that not even the phonemes at the beginning and end of adjacent sequences are repeated.

The selection process is conveniently carried out by assigning "metrics" to each individual feature. The "metrics" can be either "merit" metrics in which higher values are assigned to more desirable features or "demerit" metrics where lower values are assigned to more desirable features.

Where "merit" metrics are used the "best" metric is the highest whereas, in the case of "demerit" metrics the "best" metric is the lowest. Possible values for metrics are included in the following table:

| | MERIT | DEMERIT |
|---|---|---|
| Single Phoneme | M = 0 | D = 10 |
| Diphone | M = 2 | D = 1 |
| Triphone | M = 9 | D = 0 |
| Abutment | M = 0 | D = 4 |
| Overlap | M = 3 | D = 0 |

where "M" is a "merit" metric and D is a "demerit" metric.

A segment of text can be provided as several different string combinations and the metrics of the individual strings are added to define the metric for the combination; the combination with best metric is selected.

The number of possibilities can be kept small by working from one end of a segment to the other. It is appropriate to discard unfavourable possibilities as soon as the unfavourability is detected. This has the effect that is only necessary to retain a few favourable combinations. At the end of the sequence only one combination is retained, i.e. that with the best metric.

The rejection of unwanted alternatives produces a position in which each phoneme, except overlaps, has one, and only one, conversion. In other words the input text will have been divided into sub-strings of 1, 2 or 3 phonemes matching the database and the beginning and ending parameters for the selected streams will therefore be established. The output portion of the database takes the form of a digitized waveform and the parameters which have been established define segments of this waveform. Therefore the designated segments are selected and joined to produce the digital waveform corresponding to the input text. Where "overlaps" (as described above) occur the corresponding digital wave forms will also overlap. Because the two overlapping wave forms are derived from same phoneme they will be similar but not identical because they arise from different parts of the database. A composite wave form is produced from the two overlapping wave forms and this composite wave form constitutes an excellent join. Where the phoneme strings abut, the digital wave forms will also abut and the joint is made by simple concatenation.

This completes the requirement of the invention.

Having obtained a digital waveform this can be provided as audible output using conventional digital to analogue conversion techniques and conventional loudspeakers. If desired, the primary digital waveform can be enhanced using techniques known to those skilled in the art.

I claim:

1. A method of converting an input signal representing a text in phonemes into an output digital waveform signal convertible into an acoustic waveform corresponding to said text, wherein said method comprises:

(a) dividing said input signal into input segments, each of which is stored in an access section of a linked dtabase;

(b) for each input segment identified in step (a), retrieving an output segment of said digital waveform from an output section of the database, said output segment being that which is linked to the input segment; and (c) joining the digital output segments retrieved in step (b), said output segments being kept in the same order as the respectively associated input segments whereby the resulting output digital signal is a waveform corresponding to the input signal waveform;

the output section of the database containing an extended digital waveform containing plural contextual occurrences of each of plural phonemes in extended speech representing signals of the phonemes to be converted and having a location parameter for identifying any point therein whereby the establishment of beginning and ending location parameters defines a portion of said extended digital waveform;

step (a) including establishing beginning and ending location parameters for segments of the input signal; and step (c) including utilizing the parameters established in step (a) for retrieving a portion of stored digital waveform.

2. A method according to claim 1, further comprising comparing input windows of the input signal with stored windows contained in the input section of the database to establish a closest match for the input signal.

3. A method according to claim 2, further comprising establishing said window to have a length equivalent to 5 phonemes.

4. A method according to claim 3, in which the input section of the database is organized into three hierarchical levels; namely (i) a top level containing single phonemes corresponding to a central phoneme of a window;

(ii) a second level which contains equivalents of the second and fourth phonemes of a window; and (iii) a lowest level which contains the equivalents of the first and fifth phonemes of the window, whereby identification of a portion of the lowest level identifies a stored window of phonemes;

and wherein the comparing comprises:

selecting an exact match for the central phoneme of an input window from the top level of the hierarchy, selecting a best match for phonemes 2 and 4 from the second level of the hierarchy corresponding to the selected portion of the top level of the hierarchy and, finally, selecting from the lowest level of the hierarchy the best match for phonemes 1 and 5 from that portion of the lowest level which corresponds to the selection in the second level of the hierarchy.

5. A method of converting an input signal into an output signal, wherein:

(a) said input signal represents a text in phonemes;

(b) said output signal is a digital waveform convertible into an acoustic waveform corresponding to said text;

(c) a database is used having an input section and an output section;

(d) said output section containing an extended digital waveform having a location parameter for identifying any point therein whereby the establishment of beginning and ending location parameters defines a portion of said extended digital waveform;

(e) said input section containing segments of an extended phoneme text corresponding to the extended waveform contained in the output section; said method comprising the steps of:

(i) dividing said input signal into input segments;

(ii) matching said input segments with segments contained in the input section of the database thereby establishing beginning and ending location parameters;

(iii) retrieving from the output section of said database segments of extended digital waveform corresponding to said beginning and ending location parameters; and (iv) joining the output segments of digital waveform so retrieved, said segments being kept in the same order as the corresponding input segments.

6. A method of converting an input signal into an output signal, wherein:

(a) said input signal represents an input text in phonemes;

(b) said output signal is a digital waveform convertible into an acoustic waveform corresponding to said input text;

(c) a database is used having an input section and an output section;

(d) said output section containing an extended digital waveform having a location parameter for identifying any point therein whereby the establishment of beginning and ending location parameters defines a portion of said extended digital waveform;

(e) said input section defining context windows of an extended phoneme text corresponding to the extended waveform contained in the output section;

said method comprising the steps of:

(i) dividing said input signal into input segments;

(ii) matching said input segments with context windows contained in the input section of the database thereby establishing beginning and ending location parameters;

(iii) retrieving from the output section of said database segments of extended waveform corresponding to said beginning and ending location parameters; and (iv) joining the output segments of a digital waveform, said joined segments being kept in the same order as the corresponding input segments.

7. A method as in claim 6 wherein each context window has a length equivalent to five phonemes.

8. A method as in claim 7 in which:

the context windows are stored in three hierarchical levels comprising:

(i) a top level defining single phonemes corresponding to the third phoneme of a window;

(ii) a second level which defines equivalents of the second and fourth phonemes of a window; and (iii) a lowest level which defines equivalents of the first and fifth phonemes of the window, whereby identification of a portion of the lowest level identifies a stored window of phonemes; and the matching step comprises:

selecting an exact match for the third phoneme of the input window from a first level of the hierarchy, selecting a best match for the second and fourth phonemes from a second level of the hierarchy corresponding to the earlier selected portion of the top level of the hierarchy and, finally, selecting from the lowest level of the hierarchy a best match for the first and fifth phonemes from that portion of the lowest level which corresponds to the earlier selection in the second level of the hierarchy.

9. A method of converting a string of input phoneme text signals into an output digital waveform signal representing acoustic speech, said method comprising the steps of:

(a) storing extended digital speech waveform signals, representing plural utterances of each phoneme to be converted, in a corresponding plurality of speech contexts with different preceding and/or succeeding phonemes;

(b) dividing an input string of phonemes into input subsets of N contiguous phonemes, N being an integer;

(c) matching each said input subset with a most similar corresponding subset of N contiguous phonemes in said stored extended digital speech waveform;

(d) selecting a portion of the stored extended digital speech waveform corresponding to at least one phoneme of the match subset; and repeating at least steps (c) and (d) while concatenating the thus-selected portions of the extended digital speech waveform to provide said converted output digital waveform signal representing acoustic speech.

10. A method as in claim 9 wherein N equals five.

11. A method as in claim 9 wherein:

N equals an odd integer equal to three or greater and wherein a hierarchical database is maintained with:

(i) a top level containing single phonemes corresponding to the center of (N+1)/2 phoneme of each subset;

(ii) at least one lower level containing plural phonemes that are contiguous to the center phoneme of each subset; and said matching step includes exactly matching a single input phoneme of a subset at the top level of the hierarchical database but only best approximating a match at the lower level(s) of the hierarchical database.

12. A method for converting an input signal representing an input text in phonemes into an output digital waveform signal which is, in turn, convertible into an acoustic waveform corresponding to said input text, said method utilizing a linked database having an output section containing an extended digital waveform corresponding to an extended text in phonemes, said text including plural occurrences of individual phonemes in different contexts whereby the extended digital waveform includes plural digital waveforms for the same phoneme in different contexts and said linked database having a location parameter for identifying any point in said extended text and an equivalent point in the extended digital waveform, whereby the establishment of beginning and ending parameters in the extended text defines a portion of said digital waveform, said method including:

(a) dividing said input signal into input segments corresponding to portions of digital waveform contained in the output section of the linked database;

(b) establishing beginning and ending parameters for input segments identified in step (a);

(c) utilizing parameters established in step (b) for retrieving portions of stored digital waveform; and (d) joining the portions retrieved in step (c) in the same order as the respective input segments to produce said output digital waveform signal convertible into said acoustic waveform.

13. A method for converting an input signal representing an input text in phonemes into an output digital waveform signal which is, in turn, convertible into an acoustic waveform corresponding to said text, said method utilizing a linked database having an input section and an output section wherein the input section contains signals representing an extended text in phonemes including plural occurrences of individual phonemes in different contexts and the output section contains an extended digital waveform corresponding to the extended text of the input section of the database and having a location parameter for identifying any point in said extended text whereby the establishment of beginning and ending parameters defines a portion of said digital waveform, said method including:

(a) dividing said input signal into input segments containing input phonemes;

(b) comparing said input phonemes with the extended text contained in the input section of the database to identify the plural occurrences of said input phonemes and selecting from said plural occurrences of said input phonemes closest contexts based on the respective input segments, whereby beginning and ending parameters corresponding to input phonemes are established;

(c) utilizing the parameters established in step (b) for retrieving portions of stored digital waveform corresponding to input phonemes;

(d) joining the portions retrieved in step (c) in the same order as the respective input phonemes to produce said output digital waveform signal convertible into said acoustic waveform.

* * * * *